US007980102B2

(12) United States Patent
Kim et al.

(10) Patent No.: US 7,980,102 B2
(45) Date of Patent: Jul. 19, 2011

(54) LIQUID DETERGENT DISPENSING SYSTEM FOR A WASHING MACHINE

(75) Inventors: Kyeong Hwan Kim, Seoul (KR); Il Hyeon Jo, Seoul (KR); Jin Ho Chang, Seoul (KR); Woo Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 586 days.

(21) Appl. No.: 12/051,158

(22) Filed: Mar. 19, 2008

(65) Prior Publication Data

US 2008/0229790 A1 Sep. 25, 2008

(30) Foreign Application Priority Data

Mar. 20, 2007 (KR) ..... 10-2007-0027323

(51) Int. Cl.
*D06F 29/00* (2006.01)
*D06F 35/00* (2006.01)

(52) U.S. Cl. ..... 68/17 R

(58) Field of Classification Search ..... 68/17 R
See application file for complete search history.

(56) References Cited

U.S. PATENT DOCUMENTS 5,014,211 A * 5/1991 Turner et al. ..... 700/239
5,208,160 A * 5/1993 Kikyotani et al. ..... 435/270
6,336,468 B1 * 1/2002 Cords ..... 137/239
6,557,732 B2 * 5/2003 Van Rompuy et al. ..... 222/136
2005/0028297 A1 * 2/2005 Kim et al. ..... 8/159
2005/0097925 A1 * 5/2005 Kim et al. ..... 68/12.18
2006/0091754 A1 5/2006 Kim et al.
2006/0117811 A1 * 6/2006 Kinnetz ..... 68/17 R
2006/0150687 A1 7/2006 Chang et al.
2006/0179584 A1 8/2006 Choi et al.
2006/0191301 A1 8/2006 Park et al.
2007/0214630 A1 9/2007 Kim
2008/0141550 A1 * 6/2008 Bae et al. ..... 34/68
2008/0202173 A1 * 8/2008 Kim et al. ..... 68/17 R
2009/0095750 A1 * 4/2009 Vitan et al. ..... 220/23.83
2010/0064446 A1 * 3/2010 Bae et al. ..... 8/159

FOREIGN PATENT DOCUMENTS

DE 4420506 A1 12/1995
EP 0295525 A2 12/1988

OTHER PUBLICATIONS

U.S. Appl. No. 12/057,810 to Kim et al, filed Mar. 28, 2008.

* cited by examiner

*Primary Examiner* — Michael Barr
*Assistant Examiner* — Charles W Kling
(74) *Attorney, Agent, or Firm* — Birch, Stewart, Kolasch & Birch, LLP

(57) ABSTRACT

Disclosed is a washing machine, which prevents solidification of liquid detergent by rapidly recovering the liquid detergent left in a liquid detergent supply passage and a liquid detergent supply pump by forming a negative pressure differential by use of the liquid detergent supply pump for a set period of time after the supply of liquid detergent is finished.

15 Claims, 6 Drawing Sheets

LIQUID DETERGENT DISPENSING SYSTEM FOR A WASHING MACHINE

This Nonprovisional application claims priority under 35 U.S.C. 119(a) on Patent Application No. 10-2007-0027323 filed in Korea on Mar. 20, 2007, the entire contents of which are hereby incorporated by reference.

BACKGROUND OF THE INVENTION

1. Field of the Invention

The present invention relates to a washing machine, and more particularly, to a washing machine which uses liquid detergent.

2. Discussion of the Related Art

Generally, a washing machine performs the function of separating dirt from clothes, bedding and so on (hereinafter, referred to as 'laundry') using water, detergent and a mechanical operation. Recently, a washing machine performs even the function of drying wet laundry using a dry hot air heated by a heater and a mechanical operation.

Recently, the studies of a washing machine using liquid detergent in place of powder detergent or along with powder detergent have been going on. In such a washing machine that uses liquid detergent, if the washing machine is not used for a long time, the liquid detergent left in pipelines is easy to be solidified due to the contact with air or the like. Such a solidification of liquid detergent causes clogging of pipelines, thereby causing the washing machine to malfunction and lowering consumers' reliability on the product. Also, if liquid detergent remains in a pump that feeds liquid detergent, solidified liquid detergent may damage the pump.

Besides, the liquid detergent stored in a liquid detergent storage part is also solidified when exposed to air for a long time. In this case, it becomes difficult to smoothly supply liquid detergent required for washing.

SUMMARY OF THE INVENTION

It is an object of the present invention to provide a washing machine, which prevents solidification of liquid detergent by rapidly recovering the liquid detergent left in a liquid detergent supply passage and a liquid detergent supply pump by backwardly rotating the liquid detergent supply pump for a set period of time after the supply of liquid detergent is finished.

To achieve the foregoing object, there is provided a washing machine according to the present invention, which comprises: a washing machine body; a washing tub disposed in the washing machine body; and a liquid detergent supply pump capable of maintaining a positive pressure differential so as to supply liquid detergent into the washing tub or capable of maintaining a negative pressure differential so as to remove residual liquid detergent not supplied into the washing tub.

Furthermore, the washing machine may further comprise a liquid detergent storage part for storing the liquid detergent, and a pressure differential between the liquid detergent storage part and the washing tub may be maintained by the liquid detergent supply pump. Furthermore, the washing machine may further comprise a liquid detergent supply passage forming a passage between the washing tub and the liquid detergent storage part so as to supply the liquid detergent into the washing tub. Further, the liquid detergent supply pump may remove the liquid detergent left on the liquid detergent supply passage by maintaining a negative pressure differential.

Meanwhile, the washing machine may further comprise a detergent supply part positioned on the passage of washing water supplied into the washing tub and for mixing the washing water and detergent. The liquid detergent may be supplied into the washing tub via the detergent supply part.

Meanwhile, the liquid detergent supply pump provided in the washing machine may be operated in such a manner as to supply a predetermined liquid detergent into the washing tub depending on the amount of laundry put into the washing tub by maintaining a positive pressure differential and then remove residual liquid detergent not supplied into the washing tub by maintaining a negative pressure differential for a predetermined period of time.

Meanwhile, when the liquid detergent supply pump provided in the washing machine maintains a negative pressure differential, the washing water stored in the washing tub is sucked to remove residual liquid detergent not supplied into the washing tub. At this time, a separate means may be provided to keep the sucked washing water from being mixed with the liquid detergent.

Meanwhile, the liquid detergent supply pump provided in the washing machine may comprise a rotary pump that maintains a positive pressure differential by performing forward rotation and maintains a negative pressure differential by performing backward rotation.

Meanwhile, if the washing machine comprises a liquid detergent supply passage, a passage blocking member for blocking air contact of the liquid detergent stored in the liquid detergent storage part may be provided at one side of the liquid detergent supply passage. The passage blocking member may be disposed at an end of the liquid detergent supply passage connected to the washing tub. And, the washing machine further comprises a detergent supply part positioned on the passage of washing water supplied into the washing tub, and forming some part of the passage supplying the liquid detergent, and the passage blocking member may be disposed an end of the liquid detergent supply passage connected to the detergent supply part.

Meanwhile, the passage blocking member may include a check valve.

Meanwhile, the washing machine may further comprise a support frame for supporting the washing machine body. Further, the washing machine may further comprise a liquid detergent storage part for supplying liquid detergent supplied into the washing tub, and the liquid detergent storage part may be disposed within the support frame.

Meanwhile, the detergent supply part provided in the washing machine may include a detergent box in which powder detergent is to be put.

Meanwhile, the liquid detergent storage part provided in the washing machine may be formed in plural, and the washing machine may further comprise a switching valve for selecting at least one of the liquid detergent storage parts so as to select the liquid detergent stored in any one of the liquid detergent storage parts and supply the same into the washing tub.

Furthermore, the washing machine may further comprise a liquid detergent supply passage forming a passage between the washing tub and the liquid detergent storage part so as to supply the liquid detergent into the washing tub, the liquid detergent supply passage comprising: a first supply passage connecting the switching valve to the washing tub; and a second supply passage connecting the liquid detergent storage part to the switching valve.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Figure 1:
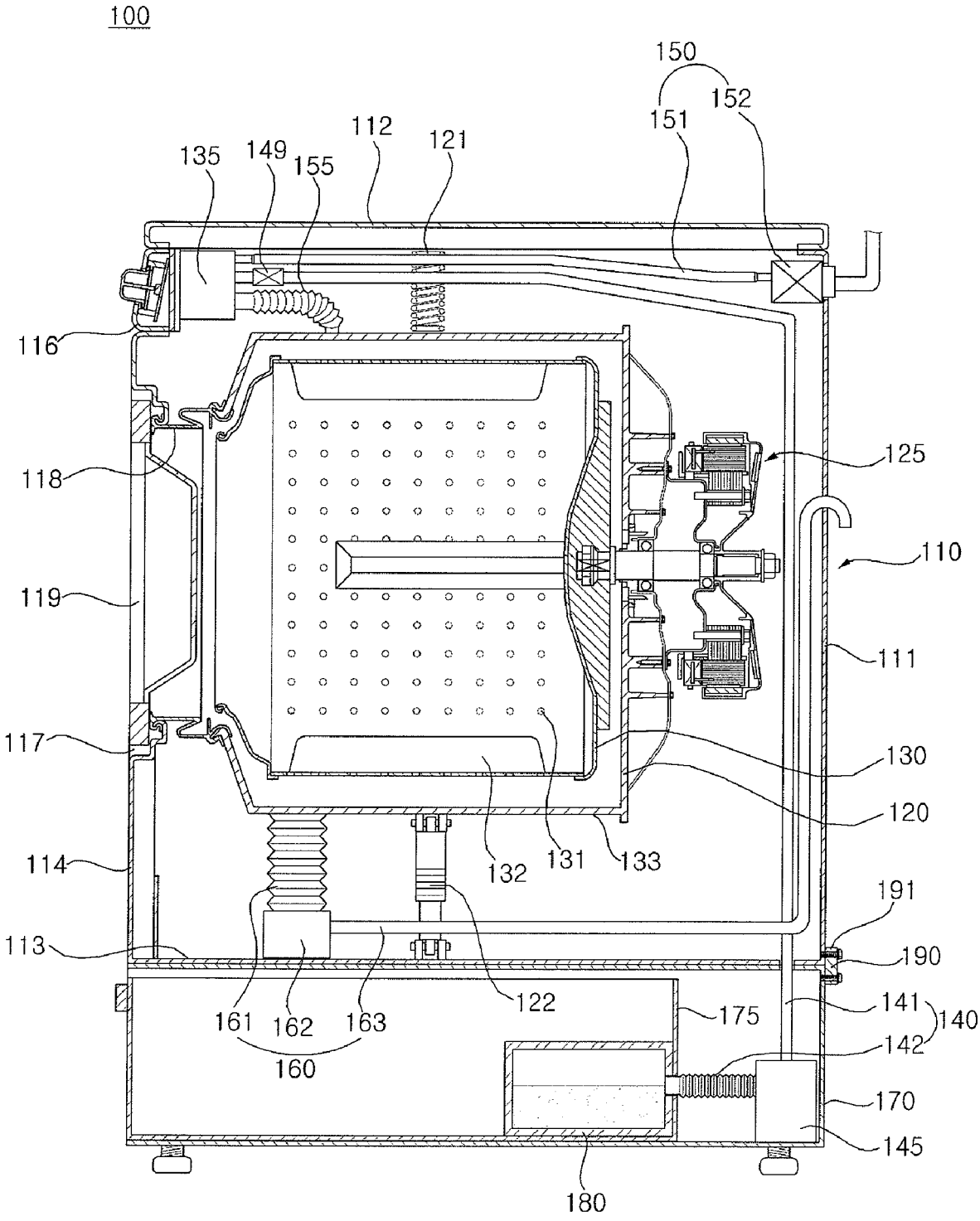
FIG. 1 is a schematic cross sectional view of a drum type washing machine according to a first embodiment of the present invention.

Hereinafter, a first embodiment of the present invention will be described with reference to FIGS. 1 to 4.

The washing machine as shown in the drawings has been illustrated with respect to a drum type washing machine among various kinds of washing machines. The scope of this invention is not limited a drum type washing machine, and the present invention may be applied to various washing machines, such as a water jet washing machine formed by a pulsator or a tower type washing machine having a slot at an upper portion within the level of those skilled in the art. Accordingly, description will be made with respect to a drum type washing machine.

FIG. 1 is a schematic cross sectional view of a washing machine 100 according to a first embodiment of the present invention. Referring to FIG. 1, the washing machine 100 includes a washing machine body 110 defining an inner space, a tub 120 disposed in the inner space so as to be buffered by a spring 121 and a damper 122 and containing washing water, a washing tub 133 provided with a plurality of through holes 131 rotatably disposed on the inside of the tub 120 to contain laundry and pass washing water through, and including a drum 130 with a lifter 132 disposed on an inner side face so as to lift laundry to a predetermined height and the drop it, and a driving apparatus 125 disposed on the rear side of the tub 120 so as to supply a rotational force to the drum 130.

The washing machine body 110 includes a main body part 111 defining the left side face, right side face, and back face of the inner space, a cover part 114 defining the front face of the inner space, and a top plate part 112 and a base part 113 defining the top face and bottom face of the inner space, respectively. An opening part 117 for putting laundry in and out is formed on the cover part 114, and a door 119 is rotatably installed thereon so as to open and close the opening part 117.

A control panel 116 for displaying the operation of the drum type washing machine 100 using sounds and/or a display unit and controlling the operation of the drum type washing machine 100 is disposed on the upper side of the cover part 114. Further, a gasket 118 is disposed between a door 119 and a tub 120. In the rotation of the drum 130, the gasket 118 buffers the shock delivered to the door 119 and prevents water leakage.

Referring to FIG. 1, the drum type washing machine 100 further includes a support frame 170 for supporting a washing machine main body 110. The support frame 170 is disposed under the washing machine body 110. The washing machine body 110 and the support frame 170 may be disposed such that a stationary member 190 connects the rear surface of the washing machine body 110 and the rear surface of the support frame 170, and the stationary member 190 may be fixed so as to be detachable from the rear surface of the washing machine body 110 and the rear surface of the frame 170 by bolts 191. Further, the lower surface of the washing machine body 110 and the upper surface of the support frame 170 may be fixed to each other by using bolts or the like. Further, the side faces of the washing machine body 110 and the side faces of the support frame 170 may be fixed to each other by using a coupling member, bolts, etc. The washing machine body 110 may not be fixed to the support frame 170 but the washing machine body 110 may be disposed on the support frame 170. However, in the present invention, the alignment structure of the washing machine body 110 and the support frame 170 is not limited to the above structure.

Meanwhile, the support frame 170 includes a drawer unit 175 that can be taken out. The drawer unit 175 is movable disposed within the support frame 170 by using a variety of structures, such as a rail structure, a roller, etc. The drawer unit 175 is opened at its top portion to thus provide an accommodating space.

The drum type washing machine 100 further includes a liquid detergent storage part 180 for storing liquid detergent. The liquid detergent storage part 180 is disposed in the drawer unit 175 of the support frame 170. Any one of various types of liquid detergents, such as liquid detergent for general laundry use, a fabric softener, a bleaching agent, etc. is stored in the liquid detergent storage part 180. The liquid detergent storage part 180 may store liquid detergent in various ways.

For example, a user may take out the drawer unit 175, open a slot (not shown) of the liquid detergent storage part 180, and then put in liquid detergent. Further, a door (not shown) accessible to the liquid detergent storage part 180 may be disposed on a side face of the support frame 170, and the user may open the door and then put liquid detergent in the liquid detergent storage part 180. Further, a liquid detergent slot (not shown) communicating with the liquid detergent storage part 180 may be disposed in the outside, and the user may put liquid detergent in the liquid detergent slot. However, the structure of the liquid detergent storage part 180 of the present invention is not limited to the above structure. Also, the number of the liquid detergent storage part 180 may be selected variously, and the size of the liquid detergent storage part 180 may be selected variously, too. Unlike this embodiment, it is apparent that the liquid detergent storage part 180 can be disposed in the washing machine body 110 or outside the support frame 170 and the main body 110.

The drum type washing machine 100 further includes a detergent supply part 135 into which washing water is introduced from outside, and which supplies the introduced washing water into the tub 120. The detergent supply part 135 is disposed so as to be accommodated in the washing machine body 110, and includes a detergent box (not shown) for putting powder detergent in.

In this way, since the drum type washing machine 100 of the present invention includes a liquid detergent storage part and a detergent supply part 135, it is possible to use liquid detergent and/or powder detergent upon laundry.

Figure 2:
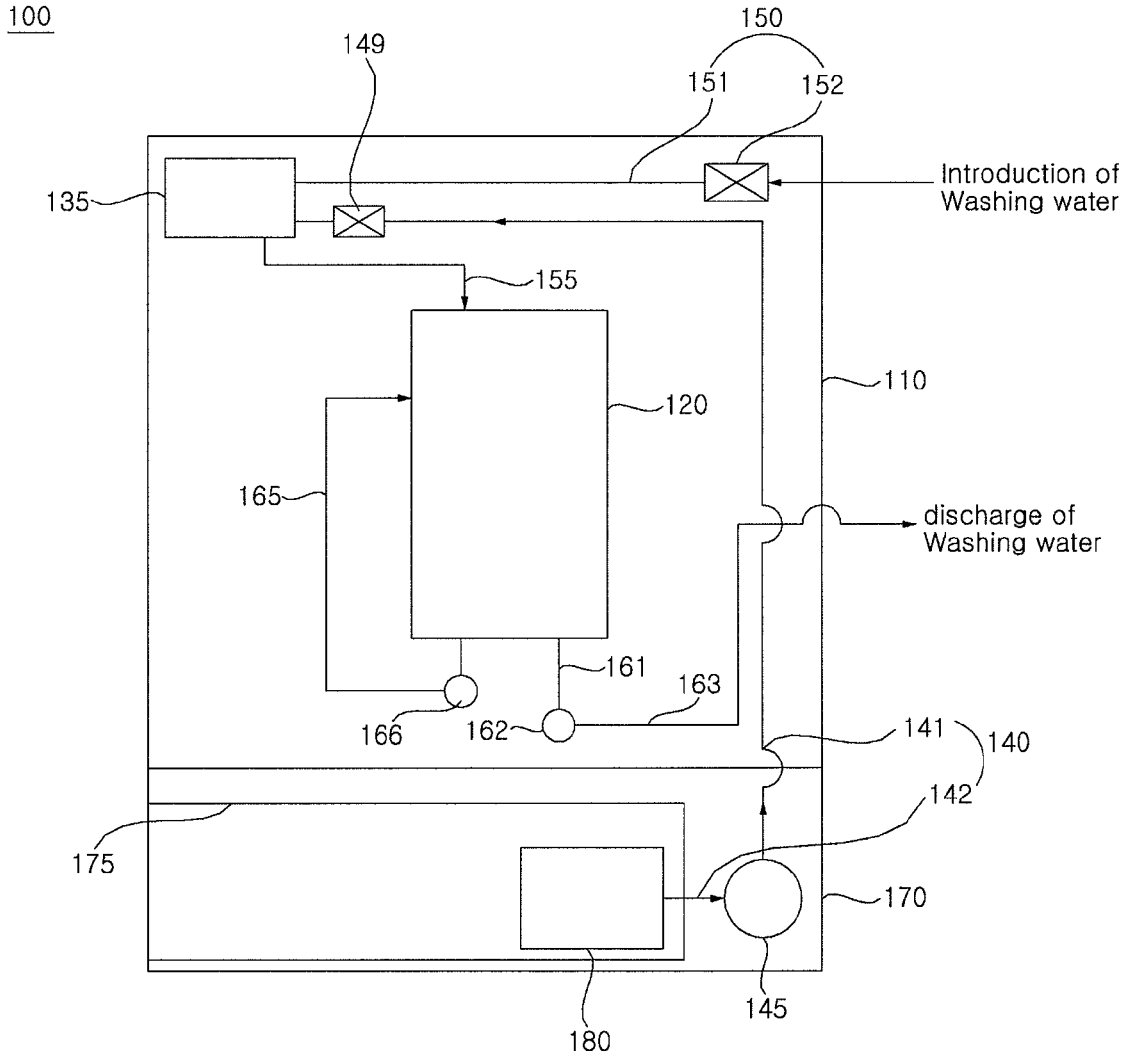
FIG. 2 is a schematic block diagram of the drum type washing machine as shown in FIG. 1.

FIG. 2 shows a schematic block diagram of the drum type washing machine 100. Referring to FIGS. 1 and 2, the drum type washing machine 100 further includes a water supply device 150 disposed between a top plate part and the tub 120 for introducing washing water from outside and a detergent supply part 135 for supplying the washing water introduced from outside through the water supply device 150 into the tub 120. The water supply device 150 includes a water supply hose 151 connecting the water supply valve 152 and the detergent supply part 135. Meanwhile, the detergent supply part 135 is disposed so as to be accommodated in the washing machine body 110, and includes a detergent box (not shown) for putting powder detergent in. In a case where powder detergent is put in the detergent box by the user, the powder detergent stored in the detergent box is mixed with the washing water introduced through the water supply hose 151, and supplied into the tub 120 through a water supply bellows 155.

In this way, since the drum type washing machine 100 of the present invention includes a liquid detergent storage part and a detergent supply part 135 for putting powder detergent in, it is possible to use liquid detergent and/or powder detergent upon laundry.

Further, the drum type washing machine 100 further includes a drainage device 160 disposed between a base part and the tub 120 to drain out the washing water stored in the tub 120. The drainage device 160 includes a drainage bellows 161 communicated to the bottom face of the tub 120, a drainage hose 163 connected to the drainage bellows 161 and for guiding residual water to outside, and a drainage pump 162 disposed between the drainage bellows 161 and the drainage hose 163.

Further, the drum type washing machine 100 further includes a circulation passage 165 communicatively connecting one side and the other side of the tub 120 and a circulation pump 166 disposed on the circulation passage 165 and for circulating the washing water in the tub 120.

Referring to FIGS. 1 and 2, the drum type washing machine 100 includes a liquid detergent supply passage 140 for guiding the liquid detergent stored in the liquid detergent storage part 180 into the detergent supply part 135 and a liquid detergent supply pump 145 capable of maintaining a positive pressure differential so as to supply liquid detergent into the washing tub 133 or capable of maintaining a negative pressure differential so as to remove the liquid detergent left and not supplied into the washing tub 133. At this time, the liquid detergent supply pump 145 can form a pressure differential by various ways, such as rotational movement or reciprocating movement. Thus, the type of the liquid detergent supply pump 145 is not restricted. In this embodiment, the liquid detergent supply pump 145 is positioned on the liquid detergent supply passage 140, and liquid detergent is fed into the washing tub 133 via the detergent supply part 135 due to the pressure differential formed by the liquid detergent supply pump 145.

The liquid detergent supply passage 140 is a passage connecting the liquid detergent storage part 180 and the detergent supply part 135. The liquid detergent stored in the liquid detergent storage part 180 via the liquid detergent supply path 140 is fed to the detergent supply part 135, and mixed with the washing water introduced from outside through the water supply hose 151 and supplied into the tub 120. In this way, since liquid detergent passes through the detergent supply part 135, is mixed with washing water, and supplied into the tub 120, it is possible to prevent damage of laundry which occurs due to direct contact of liquid detergent with the laundry. Also, the mixing of liquid detergent and washing water is improved upon laundry.

The liquid detergent supply passage 140 includes a first supply passage 141 connecting the detergent supply part 135 and the liquid detergent supply pump 145 and a second supply passage 142 connecting the liquid detergent supply pump 145 and the liquid detergent storage part 180. One side of the first supply passage 141 is connected to a discharge opening (not shown) of the liquid detergent supply pump 145, and the other side of the first supply passage 141 is connected to the detergent supply part 135 by penetrating the top face of the support frame 170 and the bottom face of the washing machine body 110.

Because the second supply passage 142 has a length-variable structure as shown in FIG. 1, the drawer unit 175 can be taken out stably. Alternatively, even if the length of the second supply passage 142 is not varied, the second supply passage 142 can have as much an allowance length as the drawer unit 175 moves. But, the structure of the second supply passage 142 of the present invention is not restricted to the above structure.

The liquid detergent supply pump 145 is disposed on the liquid detergent supply passage 140 in the support frame 170 as described above, and forms a pressure differential for feeding the liquid detergent stored in the liquid detergent storage part 180 to the washing tub 133, more specifically, the liquid detergent supply part 135. Meanwhile, in a case where a rotary pump is used as one example of the liquid detergent supply pump 145 of the present invention, the liquid detergent supply pump 145 can form a positive pressure differential by forward rotation in order to feed a set amount of liquid detergent to the detergent supply unit 135, and can form a negative pressure differential by backward rotation in order to remove the liquid detergent left in the liquid detergent supply passage 140 and the liquid detergent supply pump 145. In other words, as the liquid detergent supply pump 145 of the present invention, a rotary pump, such as a centrifugal pump and a gear pump, can be used. On the other hand, unlike this embodiment, the liquid detergent supply pump 145 can be disposed on the liquid detergent supply pump passage 140 in the washing machine body 110.

A passage blocking member 149 for blocking air contact with the liquid detergent stored in the liquid detergent storage part 180 may be provided at one side of the liquid detergent supply passage 140. The passage blocking member 149 performs the function of opening the liquid detergent supply passage 140 only while the liquid detergent stored in the liquid detergent storage part 180 is being fed to the detergent supply part 135 and closing the liquid detergent supply passage 140 after the feeding of the liquid detergent is finished. That is to say, the passage blocking member 149 avoids the liquid detergent stored in the liquid detergent storage part 180 from contacting with air by blocking the air introduced via the liquid detergent supply passage 140. In this manner, the passage blocking member 149 prevents the solidification of liquid detergent caused by contact with air.

In this embodiment, the passage blocking member 149 includes a check valve that is disposed at the end of the liquid detergent supply passage 140 connected to the detergent supply part 135 and controls the flow rate in one direction. The passage blocking member 149 configured as a check valve opens the liquid detergent supply passage 140 only when liquid detergent is fed to the detergent supply part 135 from the liquid detergent storage part 180 even if there is no separate control means. Accordingly, the air introduced to the liquid detergent storage part 180 via the detergent supply passage 140 is blocked.

However, the passage blocking member 149 is not limited to a check valve, and can be configured as various valves such as a stop valve. Further, the passage blocking member 149 may be disposed at a different position, for example, at a region where the liquid detergent supply passage 140 and the liquid detergent supply pump 145 are connected.

Figure 3:
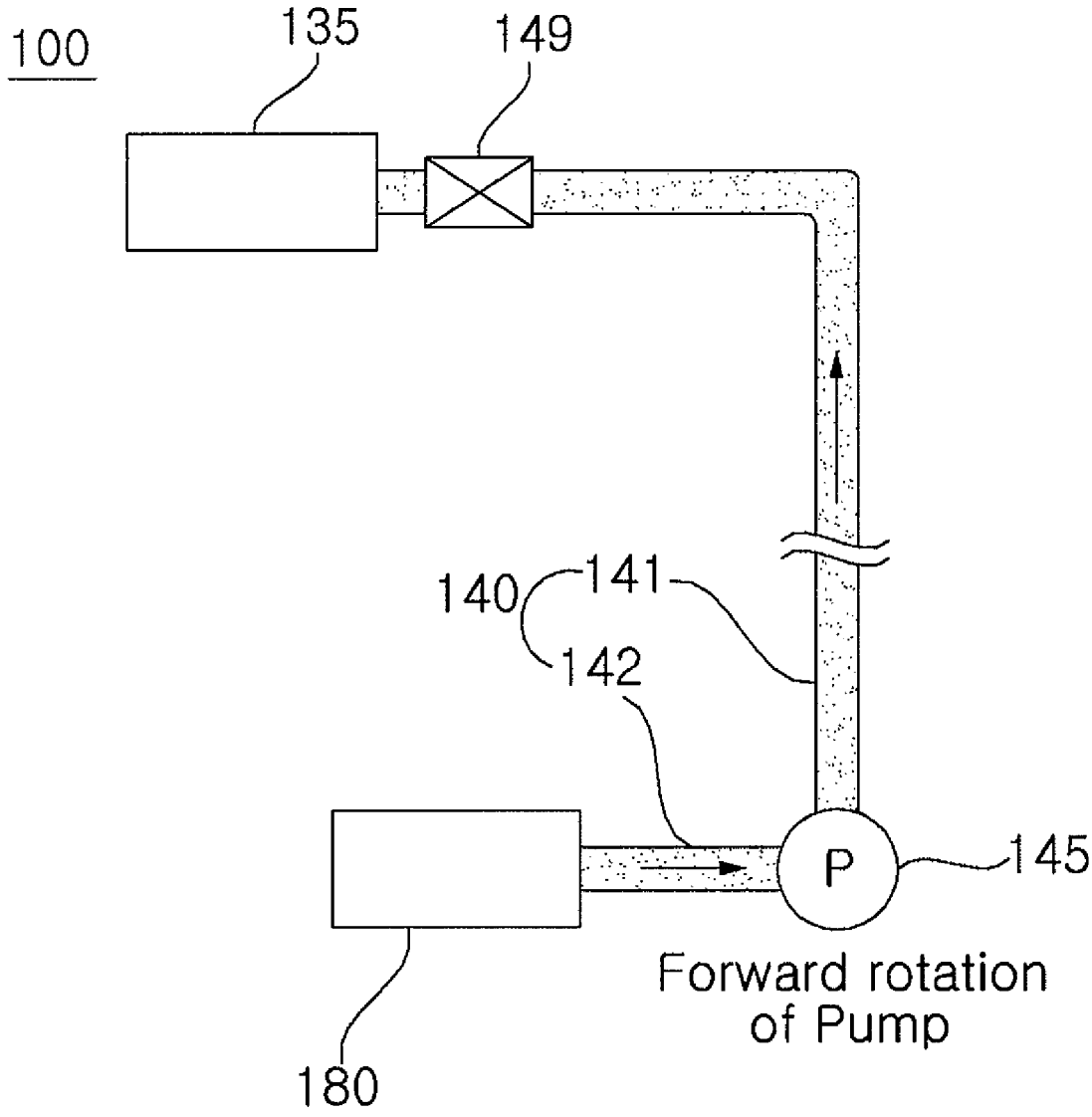
FIG. 3 is a block diagram schematically showing the flow of liquid detergent upon forward rotation of a liquid detergent supply pump in the drum type washing machine as shown in FIG. 1.
Figure 4:
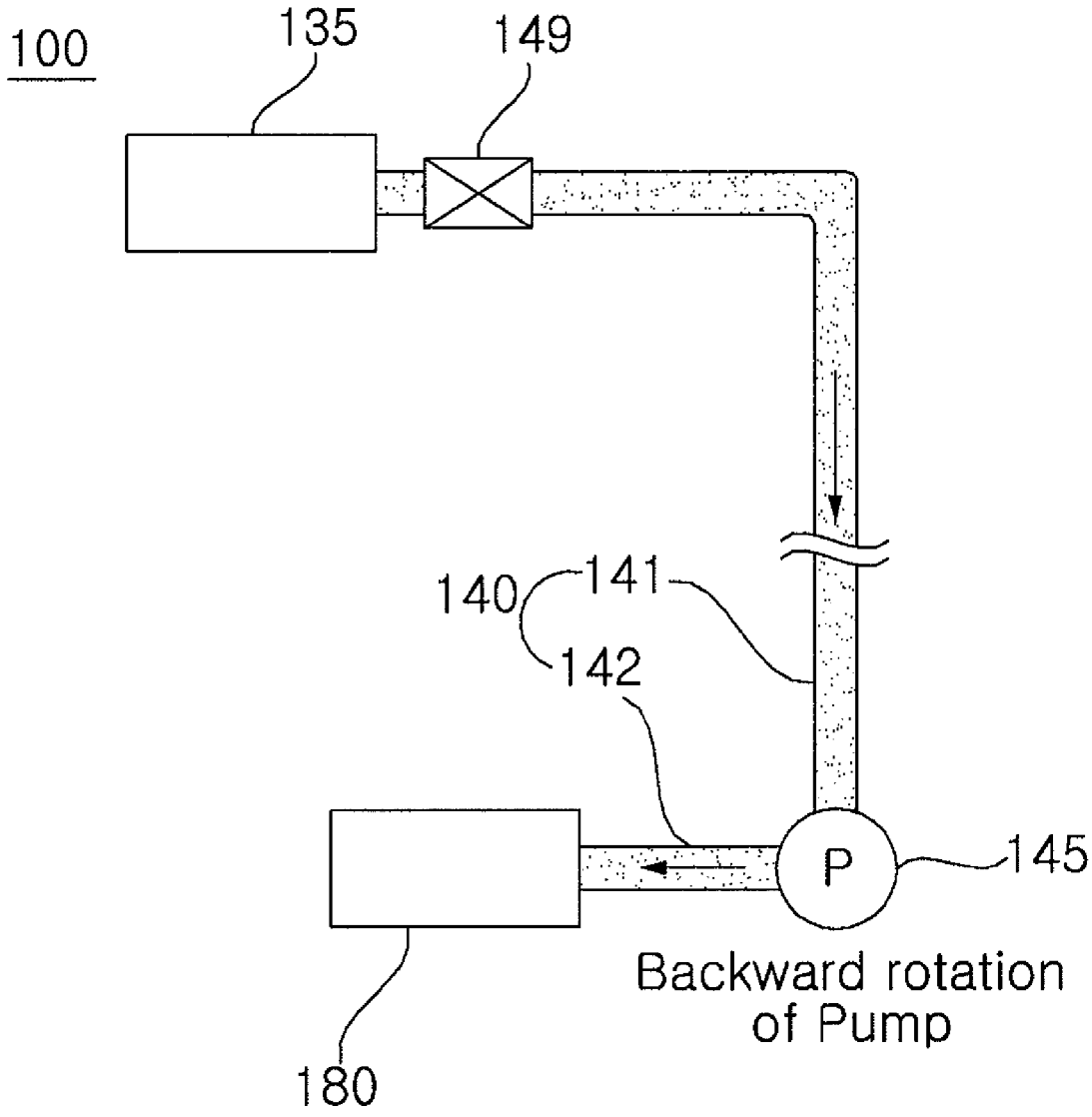
FIG. 4 is a block diagram schematically showing the flow of liquid detergent upon backward rotation of a liquid detergent supply pump in the drum type washing machine as shown in FIG. 1.

Hereinafter, referring to FIGS. 2 to 4, the operation of the drum type washing machine 100 will be described. FIG. 3 is a block diagram schematically showing the flow of liquid detergent caused by a positive pressure differential formed by the liquid detergent supply pump 145. FIG. 4 is a block diagram schematically showing the flow of liquid detergent caused by a negative pressure differential formed by the liquid detergent supply pump 145.

When a washing course is inputted by a user and laundry is put in the drum 130, a controller (not shown) of the drum type washing machine 100 automatically detects the volume of laundry. The controller determines the supply amount of washing water and the supply amount of liquid detergent depending on the detected volume of laundry. At this time, powder detergent may be separately supplied into the detergent supply part 135 by the user. Thereafter, as shown in FIG. 3, the controller forms a positive pressure differential by forward rotation of the liquid detergent supply pump 145, and supplies an appropriate amount of liquid detergent corresponding to the volume of laundry to the detergent supply part 135 by the positive pressure differential. Once the supply of the liquid detergent is finished, as shown in FIG. 4, the controller forms a negative pressure differential by backward rotation of the liquid detergent supply pump 145 for a set period of time, and recovers the liquid detergent left in the liquid detergent supply passage 140 to the liquid detergent storage part 180 by the negative pressure differential. Afterwards, washing water is introduced to the detergent supply part 135 from outside via the water supply hose 151. Otherwise, the supply of liquid detergent and the supply of washing water may be performed simultaneously. An introduced washing water is mixed with the liquid detergent introduced to the detergent supply part 135 and introduced into the tub 120 through the water supply bellows 155. Hereinafter, a washing stroke is performed according to a set logic function.

Generally, the solidification of liquid detergent occurs within the liquid detergent supply passage 140 and the liquid detergent supply pump 145. The liquid detergent left in the liquid detergent supply passage 140 and the liquid detergent supply pump 145 is recovered to the liquid detergent storage part 180 to a certain extent by its self-weight. However, it is generally difficult for liquid detergent having a higher viscosity than washing water has to be sufficiently recovered to the liquid detergent storage part 180 only by its self-weight, and a lot of time is required. Especially, it is very difficult to recover the liquid detergent left in transverse regions of the liquid detergent supply passage 140.

As described above, the liquid detergent supply pump 145 of the present invention has a backward rotation function. Thus, in the present invention, it is possible to rapidly recover the liquid detergent left in the liquid detergent supply passage 140 and the liquid detergent supply pump 145 to the liquid detergent storage part 180 by backward rotation of the liquid detergent supply pump 145 for a set period of time after the supply of the liquid detergent is finished. In this manner, the present invention can minimize the problem of solidification of liquid detergent that occurs within the liquid detergent supply passage 140 and the liquid detergent supply pump 145. Accordingly, the present invention can prevent the problems caused by the solidification of liquid detergent, for example, deterioration of the washing performance caused by the clogging of the passages, damage to the pump and so on. Moreover, it is possible to precisely supply a set amount of liquid detergent depending on the volume of laundry by properly controlling a positive pressure differential or negative pressure differential formed by the liquid detergent supply pump 145.

Figure 5:
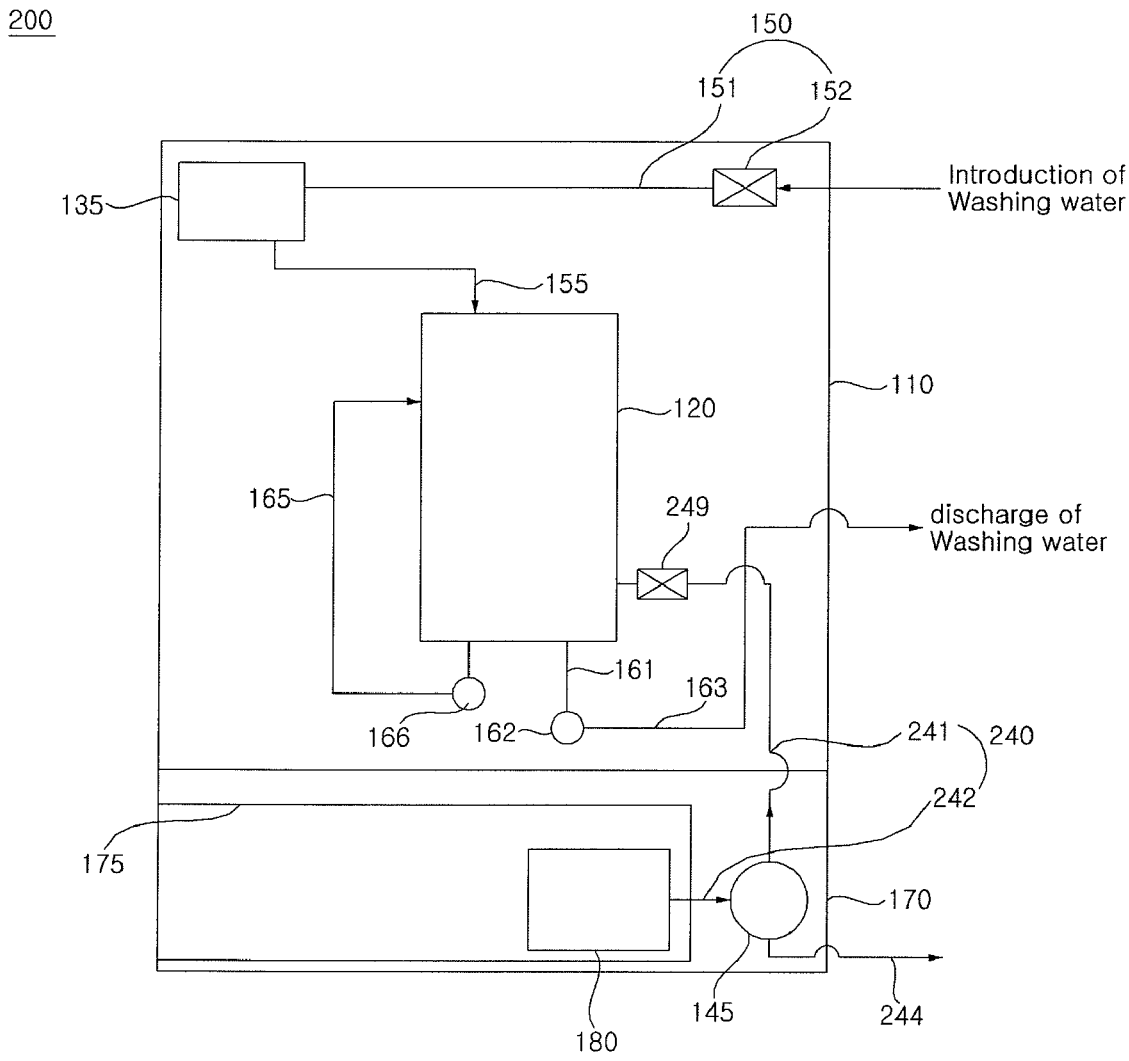
FIG. 5 is a schematic block diagram of a drum type washing machine according to another embodiment of the present invention.

FIG. 5 illustrates a schematic block diagram of a washing machine 200 according to a second embodiment of the present invention. The same reference numerals as those in the above embodiment represent the same reference members. Hereinafter, the description will be made with respect to differences with the above embodiment.

Referring to FIG. 5, a liquid detergent supply passage 240 connects between the liquid detergent storage part 180 and the tub 120. The liquid detergent supply passage 240 includes a first supply passage 241 connecting between the tub 120 and the liquid detergent supply pump 145 and a second supply passage 242 connecting between the liquid detergent supply pump 145 and the liquid detergent storage part 180.

In the drum type washing machine as shown in FIG. 2, liquid detergent is firstly introduced into the detergent supply part 135, and then supplied into the tub 120 via the water supply bellows 155. However, in the drum type washing machine 200 of this embodiment, liquid detergent is directly supplied into the tub 120.

Accordingly, the length of the liquid detergent supply passage 240 is shortened, and thus a head difference between the liquid detergent storage part 180 and a liquid detergent supply position decreases. Resultantly, there is a merit that the capacity of the liquid detergent supply pump 145 can be reduced. Besides, if the water supply hose 151 is directly connected to the tub 120, the construction of the detergent supply part 135 can be omitted.

Meanwhile, in this embodiment, the liquid detergent left in the first detergent supply passage 241 and the liquid detergent supply pump 145 can be removed by using the washing water in the washing tub 133. That is, if the first supply passage 241 is connected to a lower portion of the washing tub 133, the washing water collected in the washing tub 133 while the liquid detergent supply pump 145 forms a negative pressure differential is sucked by the negative pressure differential, and passes through the first supply passage 241 and the detergent supply pump 145, thereby removing the liquid detergent left in the first supply passage 241 and the detergent supply pump 145. However, in order to prevent the sucked washing water from being sucked to the liquid detergent storage part 180 and mixed with the liquid detergent, a cleaning solution drainage passage 244 may be connected to the liquid detergent supply pump 145 so that the washing water sucked to the liquid detergent supply pump 145 may be discharged out of the liquid detergent supply pump 145. Also, by using a valve (not shown) that may be provided in the liquid detergent supply pump 145, an exit directed to the liquid detergent supply pump can be blocked and an exit on the cleaning solution drainage passage 244 can be opened while the washing water is being sucked, so that the sucked washing water can be discharged out.

Meanwhile, in a case where the first supply passage 241 is connected to an upper portion of the washing tub 133 so as to keep washing water from being sucked while the liquid detergent supply pump 145 is forming a negative pressure differential, or, as shown in FIG. 5, the passage blocking member 249 is disposed at the end of the liquid detergent supply passage, the washing water is prevented from being sucked, thereby requiring no cleaning solution drainage passage 244.

Figure 6:
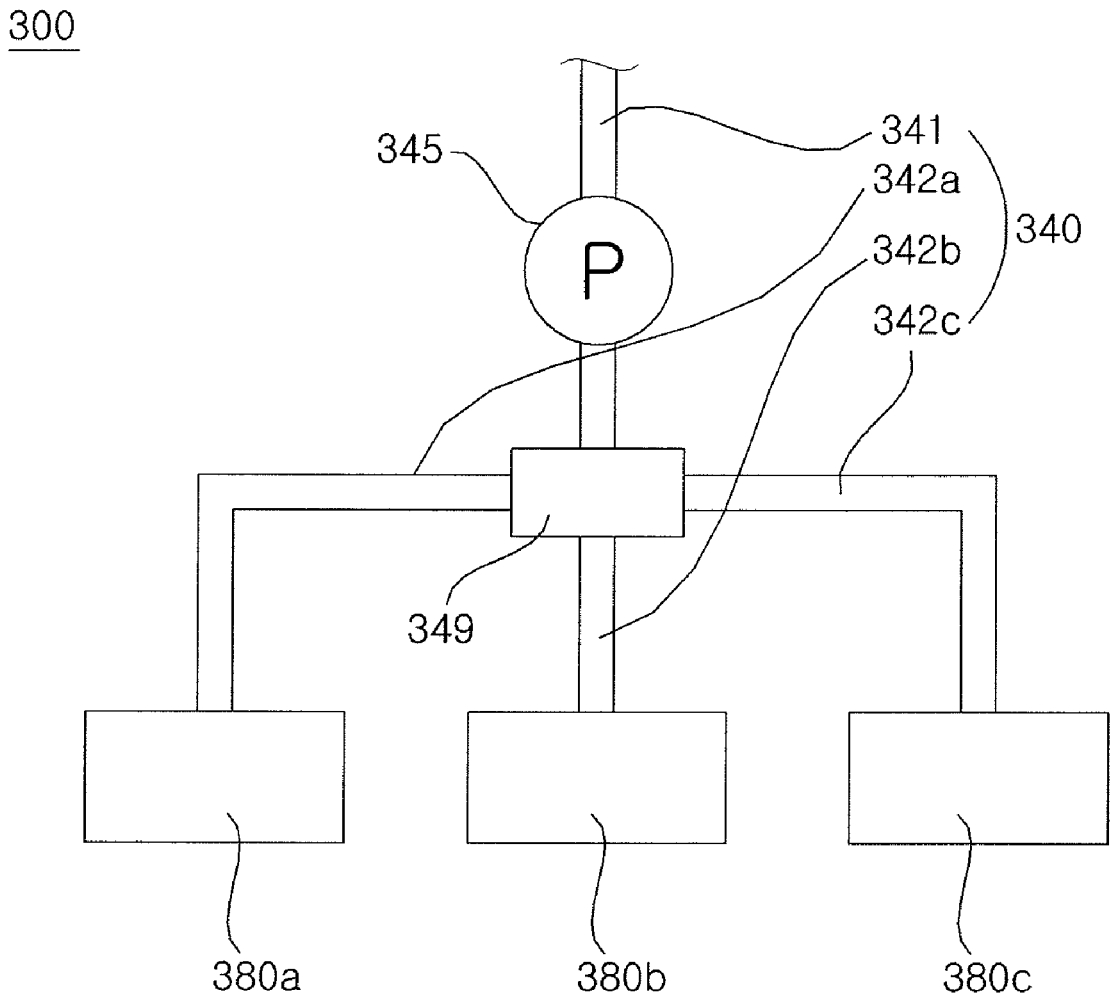
FIG. 6 is a schematic block diagram of a drum type washing machine according to still another embodiment of the present invention.

FIG. 6 illustrates a schematic block diagram of a drum type washing machine 300 according to a third embodiment of the present invention. The components not shown in FIG. 6 will be explained with reference to FIGS. 1 and 2. Hereinafter, the description will be made with respect to differences with the above embodiment.

Referring to FIG. 6, the washing machine 300 includes a first liquid detergent storage part 380*a*, a second liquid detergent storage part 380*b*, and a third liquid detergent storage part 380*c*. Each of the liquid detergents storage parts 380*a*, 380*b*, and 380*c* can store a different kind of liquid detergent. For example, the first liquid detergent storage part 380*a* may store liquid detergent for general laundry use, the second liquid detergent storage part 380*b* may store a fabric softener in a liquid from, and the third liquid detergent storage part 380*c* may store a bleaching agent in a liquid form.

Furthermore, the washing machine 300 further includes a switching valve 349 disposed on the liquid detergent supply passage 340 in order to select the liquid detergent stored in any one of the liquid detergent storage parts 380*a*, 380*b*, and 380*c* and guide the same into the detergent supply part 135.

The liquid detergent supply passage 340 includes a first supply passage 341 connecting between the detergent supply part 135 and the switching valve 349 and second supply passages 342*a*, 342*b*, and 342*c* connecting the switching valve 349 and each of the liquid detergent storage parts 380*a*, 380*b*, and 380*c*. Otherwise, the first supply passage 341 may connect between the tub 120 and the switching valve 349 like the drum type washing machine 200 as shown in FIG. 5. A liquid detergent supply pump 345 is disposed on the first supply passage 341.

The switching valve 349 is controlled to communicate with any one of the first supply passage 341 and three second supply passages 342*a*, 342*b*, and 342*c* connected to the liquid detergent storage parts 380*a*, 380*b*, and 380*c*, respectively, in order to supply a required type of liquid detergent depending on a washing course.

In this way, the present invention has the merit that different types of liquid detergents required depending on a washing course can be selectively used by having a plurality of liquid detergent storage parts 380*a*, 380*b*, and 380*c* and disposing the switching valve 349 on the liquid detergent supply passage 340.

Although the present invention has been described in details with reference to preferred embodiments, the scope of the present invention is not limited to a specific embodiment but may be construed only in view of the appended claims. It is to be understood by those skilled in the art that various changes and modifications may be made without departing from the spirit and scope of the present invention.

What is claimed is:

1. A liquid detergent dispensing system for a washing machine, comprising:

a washing machine housing;

a washing tub disposed in the washing machine housing;

a liquid detergent storage container configured to store a liquid detergent;

a liquid detergent supply pump configured to provide a positive pressure differential for supplying the liquid detergent to the washing tub, and configured to provide a negative pressure differential for removing residual liquid detergent not supplied to the washing tub;

a support frame disposed under the washing machine housing to support the washing machine housing, the liquid detergent storage container being placed within the support frame; and a liquid detergent supply passage provided between the washing tub and the liquid detergent storage container, the liquid detergent being supplied to the washing tub through the liquid detergent supply passage.

2. The liquid detergent dispensing system of claim 1, wherein the liquid detergent supply pump removes residual liquid detergent remaining in the liquid detergent supply passage by providing the negative pressure differential.

3. The liquid detergent dispensing system of claim 1, wherein the liquid detergent supply pump is operated to supply a predetermined amount of liquid detergent to the washing tub, corresponding to the amount of laundry in the washing tub, by providing the positive pressure differential, and is then operated to remove residual liquid detergent not supplied to the washing tub by providing the negative pressure differential for a predetermined period of time.

4. The liquid detergent dispensing system of claim 1, wherein, while the liquid detergent supply pump provides the negative pressure differential, washing water in the washing tub is sucked to remove residual liquid detergent not supplied to the washing tub.

5. The liquid detergent dispensing system of claim 1, wherein the liquid detergent supply pump comprises a rotary pump that provides a positive pressure differential during forward rotation and provides the negative pressure differential during backward rotation.

6. The liquid detergent dispensing system of claim 1, wherein a passage blocker that prevents air from contacting the liquid detergent stored in the liquid detergent storage container is provided at one end of the liquid detergent supply passage.

7. The liquid detergent dispensing system of claim 6, wherein the passage blocker is disposed at an end of the liquid detergent supply passage connected to the washing tub.

8. The liquid detergent dispensing system of claim 6, further comprising a detergent supply unit positioned along a passage through which washing water is supplied to the washing tub, and forming a portion of the liquid detergent supply passage, wherein the passage blocker is disposed at an end of the liquid detergent supply passage connected to the detergent supply unit.

9. The liquid detergent dispensing system of claim 6, wherein the passage blocker includes a check valve.

10. The liquid detergent dispensing system of claim 1, wherein the liquid detergent storage container includes plural containers, the washing machine further comprising a switching valve configured to switch between the liquid detergent storage containers for selecting the liquid detergent stored in any one of the liquid detergent storage containers for supply to the washing tub.

11. The liquid detergent dispensing system of claim 10, wherein the liquid detergent supply passage includes:

a first supply passage connecting the switching valve to the washing tub; and a second supply passage connecting the liquid detergent storage container to the switching valve.

12. The liquid detergent dispensing system of claim 1, wherein the support frame includes a drawer unit movably installed therein, and the liquid detergent storage container is disposed in the drawer.

13. The liquid detergent dispensing system of claim 1, wherein a stationary member is fixed to the washing machine housing and the support frame.

14. A liquid detergent dispensing system for a washing machine, comprising:

a washing machine housing;

a washing tub disposed in the washing machine housing;

a liquid detergent storage container configured to store a liquid detergent;

a liquid detergent supply pump configured to provide a positive pressure differential for supplying the liquid detergent to the washing tub, and configured to provide a negative pressure differential for removing residual liquid detergent not supplied to the washing tub;

a support frame disposed under the washing machine housing to support the washing machine housing, the liquid detergent storage container being placed within the support frame; and a detergent supply unit positioned along a passage through which washing water is supplied to the washing tub, the washing water and detergent being mixed together in the detergent supply unit, wherein the liquid detergent is supplied from the liquid detergent storage container to the washing tub via the detergent supply unit.

15. The liquid detergent dispensing system of claim 14, wherein the detergent supply unit includes a detergent box configured to receive powder detergent therein.

* * * * *